US009890782B2

(12) United States Patent
Sakai et al.

(10) Patent No.: US 9,890,782 B2
(45) Date of Patent: Feb. 13, 2018

(54) FLUID PUMP WITH RADIAL BEARING BETWEEN INNER ROTOR AND ROTARY SHAFT AND LUBRICATION GROOVE IN OUTER PERIPHERAL SURFACE OF RADIAL BEARING

(71) Applicant: DENSO CORPORATION, Kariya, Aichi-pref. (JP)

(72) Inventors: Hiromi Sakai, Kariya (JP); Daiji Furuhashi, Kariya (JP)

(73) Assignee: DENSO CORPORATION, Kariya (JP)

( * ) Notice: Subject to any disclaimer, the term of this patent is extended or adjusted under 35 U.S.C. 154(b) by 31 days.

(21) Appl. No.: 15/096,657

(22) Filed: Apr. 12, 2016

(65) Prior Publication Data

US 2016/0298625 A1 Oct. 13, 2016

(30) Foreign Application Priority Data

Apr. 13, 2015 (JP) ..... 2015-81916

(51) Int. Cl.

| | |
|---|---|
| ***F01C 21/04*** | (2006.01) |
| ***F03C 2/00*** | (2006.01) |
| ***F03C 4/00*** | (2006.01) |
| ***F04C 2/00*** | (2006.01) |
| ***F04C 2/10*** | (2006.01) |

(Continued)

(52) U.S. Cl.

CPC ..... *F04C 2/102* (2013.01); *F04C 15/0092* (2013.01); *F04C 15/06* (2013.01); *F04C 2210/1044* (2013.01); *F04C 2240/50* (2013.01); *F04C 2240/56* (2013.01); *F05C 2253/20* (2013.01)

(58) Field of Classification Search

CPC ..... F04C 2/102; F04C 2/084; F04C 15/0092; F04C 2210/1044; F04C 2240/20; F04C 2240/30; F04C 2240/50; F04C 2240/56; F05C 2253/20

USPC ..... 418/166, 171, 83, 152

See application file for complete search history.

(56) References Cited

U.S. PATENT DOCUMENTS 2,466,428 A * 4/1949 Hufferd ..... F16J 9/06 277/468

3,572,729 A * 3/1971 Hodil, Jr. ..... F41A 3/74 277/647

(Continued)

FOREIGN PATENT DOCUMENTS

| | | |
|---|---|---|
| JP | 63-92090 | 6/1988 |
| JP | 2009-174448 | 8/2009 |

(Continued)

*Primary Examiner* — Theresa Trieu

(74) *Attorney, Agent, or Firm* — Nixon & Vanderhye P.C.

(57) ABSTRACT

A pump housing receives an outer rotor and an inner rotor. A joint member couples between a rotatable shaft and the inner rotor to transmit a rotational torque from the rotatable shaft to the inner rotor. A radial bearing is shaped into a cylindrical tubular form. A cylindrical inner peripheral surface of the radial bearing rotatably and slidably supports the rotatable shaft. A cylindrical outer peripheral surface of the radial bearing rotatably and slidably supports an inner peripheral surface of the inner rotor. A lubrication groove is formed in the cylindrical outer peripheral surface of the radial bearing and accumulates fluid, which is present in an inside of the pump housing.

7 Claims, 10 Drawing Sheets

(51) Int. Cl.
*F04C 15/00* (2006.01)
*F04C 15/06* (2006.01)

(56) References Cited

U.S. PATENT DOCUMENTS

| | | | | | |
|---|---|---|---|---|---|
| 4,820,138 | A | * | 4/1989 | Bollinger | F04C 2/102 418/171 |
| 5,263,818 | A | * | 11/1993 | Ito | F04C 2/102 418/171 |
| 5,340,293 | A | | 8/1994 | Yasuda et al. | |
| 6,082,984 | A | * | 7/2000 | Matsumoto | F04C 2/102 418/171 |
| 2007/0039185 | A1 | | 2/2007 | Chen et al. | |

FOREIGN PATENT DOCUMENTS

| | | |
|---|---|---|
| JP | 2012-189011 | 10/2012 |
| JP | 2013-60901 | 4/2013 |

* cited by examiner

FLUID PUMP WITH RADIAL BEARING BETWEEN INNER ROTOR AND ROTARY SHAFT AND LUBRICATION GROOVE IN OUTER PERIPHERAL SURFACE OF RADIAL BEARING

CROSS REFERENCE TO RELATED APPLICATION

This application is based on and incorporates herein by reference Japanese Patent Application No. 2015-81916 filed on Apr. 13, 2015.

TECHNICAL FIELD

The present disclosure relates to a fluid pump that draws and discharges fluid by changing a volume of respective pump chambers formed between external teeth of an inner rotor and internal teeth of an outer rotor.

BACKGROUND

A previously proposed fluid pump has an inner rotor, an outer rotor, a pump housing and a rotatable shaft. The inner rotor includes external teeth, and the outer rotor includes internal teeth for meshing with the external teeth. The pump housing receives the inner rotor and the outer rotor. The rotatable shaft drives the inner rotor to rotate the same. When the inner rotor is rotated by rotating the rotatable shaft, a rotational force of the inner rotor is transmitted from the external teeth to the internal teeth. Thereby, the outer rotor is also rotated. When the inner rotor and the outer rotor are rotated, the volume of the respective pump chambers, which are formed between the external teeth and the internal teeth, changes. In response to increasing of the volume of the pump chamber, the fluid is drawn into the pump chamber. Thereafter, in response to decreasing of the volume of the pump chamber, the fluid is compressed in the pump chamber and is discharged from the pump chamber (see, for example, JP2013-60901A).

In a case where a repulsive force, which is applied from the fluid to the inner rotor, is large, like in a case where viscosity of the fluid is high, a force (tilting force), which is applied from the fluid to the inner rotor in a direction for tilting the inner rotor relative to the rotatable shaft, is increased. Thereby, a slide resistance between a radial bearing, which rotatably and slidably supports the rotatable shaft, and the rotatable shaft is increased to cause an increase in the energy loss or generation of damage at a sliding portion between the radial bearing and the rotatable shaft.

With respect to the above point, the inventors of the present application have studied a structure for coupling the inner rotor to the rotatable shaft through a joint member rather than directly coupling the inner rotor to the rotatable shaft. With this structure, the above-described tilting force can be absorbed through resilient deformation of the joint member, and thereby the slide resistance between the radial bearing and the rotatable shaft can be reduced.

In the above coupling structure, since the inner rotor is not directly coupled to the rotatable shaft, it is necessary to provide a member that rotatably and slidably supports the inner rotor. The inventors of the present application have studied a structure that slidably supports the rotatable shaft through a cylindrical inner peripheral surface of a radial bearing and also slidably supports the inner rotor through a cylindrical outer peripheral surface of the radial bearing.

However, the inventors of the present application have noticed that the above-described bearing structure poses the following new disadvantage. That is, the rotatable shaft is placed to extend over both of a high pressure passage, which conducts the fluid discharged from each corresponding one of pump chambers, and an inside of the pump housing. Thereby, the fluid in the high pressure passage penetrates into an area between the cylindrical inner peripheral surface of the radial bearing and the rotatable shaft to implement lubricating function. In contrast, it is difficult to provide a structure, which enables penetration of high pressure fluid between the cylindrical outer peripheral surface of the radial bearing and the inner rotor, so that the lubricating function of the fluid cannot be expected. Therefore, the slide resistance of the inner rotor cannot be sufficiently reduced in comparison to the slide resistance of the rotatable shaft.

That is, in the case where the above structure is adapted, although the tilting force can be absorbed through the joint member, there is required a structure that slidably supports the inner rotor. In this case, there is the new disadvantage of that the slide resistance of the inner rotor cannot be sufficiently reduced.

SUMMARY

The present disclosure is made in view of the above point. According to the present disclosure, there is provided a fluid pump that includes an inner rotor, an outer rotor, a pump housing, a rotatable shaft, a joint member and a radial bearing. The inner rotor is shaped into a cylindrical tubular form and has a plurality of external teeth. The outer rotor has a plurality of internal teeth for meshing with the plurality of external teeth. The pump housing receives the outer rotor and the inner rotor and forms a plurality of pump chambers between the plurality of internal teeth and the plurality of external teeth. Each of the plurality of pump chambers draws and compresses fluid by changing a volume of the pump chamber. The rotatable shaft is placed to extend over both of: a high pressure passage, which conducts the fluid discharged from each corresponding one of the plurality of pump chambers; and an inside of the pump housing. The joint member couples between the inner rotor and the rotatable shaft to transmit a rotational torque of the rotatable shaft to the inner rotor. The radial bearing is shaped into a cylindrical tubular form. The radial bearing rotatably and slidably supports the rotatable shaft through a cylindrical inner peripheral surface of the radial bearing and rotatably and slidably supports an inner peripheral surface of the inner rotor through a cylindrical outer peripheral surface of the radial bearing. At least one lubrication groove is formed in the cylindrical outer peripheral surface of the radial bearing and accumulates the fluid, which is present in the inside of the pump housing.

BRIEF DESCRIPTION OF THE DRAWINGS

The drawings described herein are for illustration purposes only and are not intended to limit the scope of the present disclosure in any way.

DETAILED DESCRIPTION

An embodiment of a fluid pump according to the present disclosure will be described with reference to the accompanying drawings. The fluid pump of the present embodiment is installed in a vehicle. A subject fluid to be pumped with the fluid pump is liquid fuel used for combustion in an internal combustion engine. Specifically, in the present embodiment, light oil (diesel fuel), which is used for combustion in a compression self-ignition internal combustion engine, is used as the subject fluid to be pumped. The fluid pump is received in an inside of a fuel tank.

Figure 1:
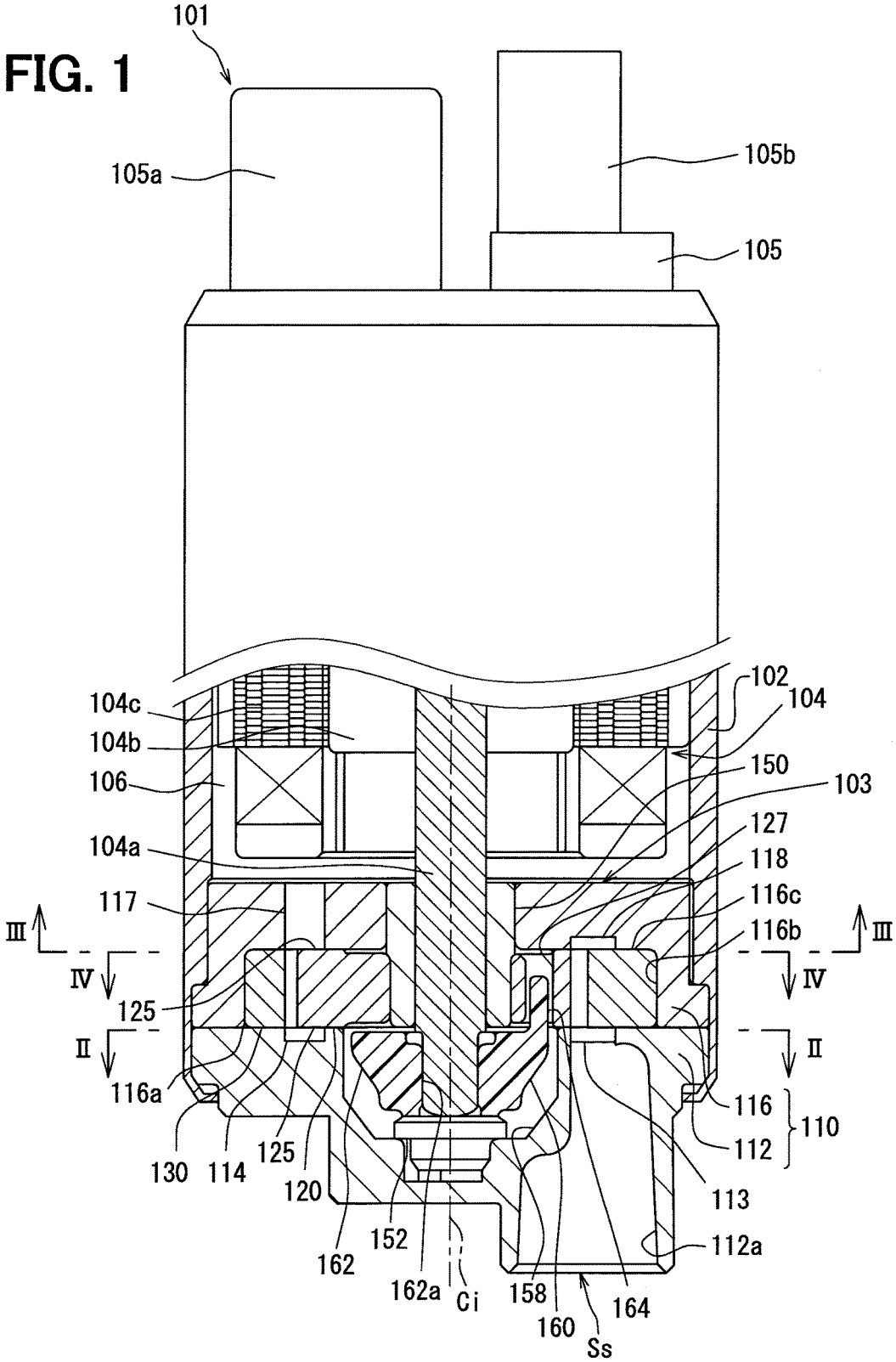
FIG. 1 is a partial cross-sectional view indicating a fuel pump according to an embodiment of the present disclosure.

As shown in FIG. 1, the fluid pump 101 of the present embodiment is a rotary internal gear pump of a positive displacement type. The fluid pump 101 includes a pump body 102, a pump main body 103, an electric motor 104 and a side cover 105. The pump main body 103 and the electric motor 104 are received in an inside of the pump body 102, which is shaped into a cylindrical tubular form, such that the pump main body 103 and the electric motor 104 are arranged one after another in an axial direction. The side cover 105 is installed to an opening of one of two axially opposite end parts of the pump body 102, which is located on the electric motor 104 side. The side cover 105 includes an electric connector 105*a*, which supplies an electric power to the electric motor 104, and a discharge port 105*b*, through which fuel is discharged from the fluid pump 101. In the fluid pump 101, a rotatable shaft 104*a* of the electric motor 104 is rotated when the electric power is supplied from an external circuit through the electric connector 105*a*. Thus, an outer rotor 130 and an inner rotor 120 of the pump main body 103 are rotated by a drive force of the rotatable shaft 104*a* of the electric motor 104, and thereby fuel is drawn into and compressed in the fluid pump 101 and is then discharged from the fluid pump 101 through the discharge port 105*b*. The fluid pump 101 pumps the light oil, which has the higher viscosity in comparison to gasoline, as the fuel.

In the present embodiment, the electric motor 104 is an inner rotor brushless motor and includes magnets 104*b*, which form four magnetic poles, and coils 104*c*, which are installed in six slots. For example, at a start preparation time (e.g., a time of turning on of an ignition switch of the vehicle), a positioning control operation of the electric motor 104 is executed to rotate the rotatable shaft 104*a* toward a drive rotation side or a counter-drive rotation side (the counter-drive rotation side being opposite from the drive rotation side). Thereafter, the electric motor 104 executes a drive control operation, which rotates the rotatable shaft 104*a* from the position, at which the rotatable shaft 104*a* is positioned in the positioning control operation, toward the drive rotation side.

Here, the drive rotation side is a positive direction side of a rotational direction Ri of the inner rotor 120 in a circumferential direction of the inner rotor 120. The counter-drive rotation side is a negative direction side of the rotational direction Ri of the inner rotor 120, which is opposite from the positive direction side.

Hereinafter, the pump main body 103 will be described in detail. The pump main body 103 includes a pump housing 110, the inner rotor 120, the outer rotor 130 and a joint member 160. The pump housing 110 includes a pump cover 112 and a pump casing 116, which are placed one after another in the axial direction.

The pump cover 112 is made of metal and is shaped into a circular disk form. The pump cover 112 axially projects outward from the end part of the pump body 102, which is located on the side of the electric motor 104 that is opposite from the side cover 105.

Figure 2:
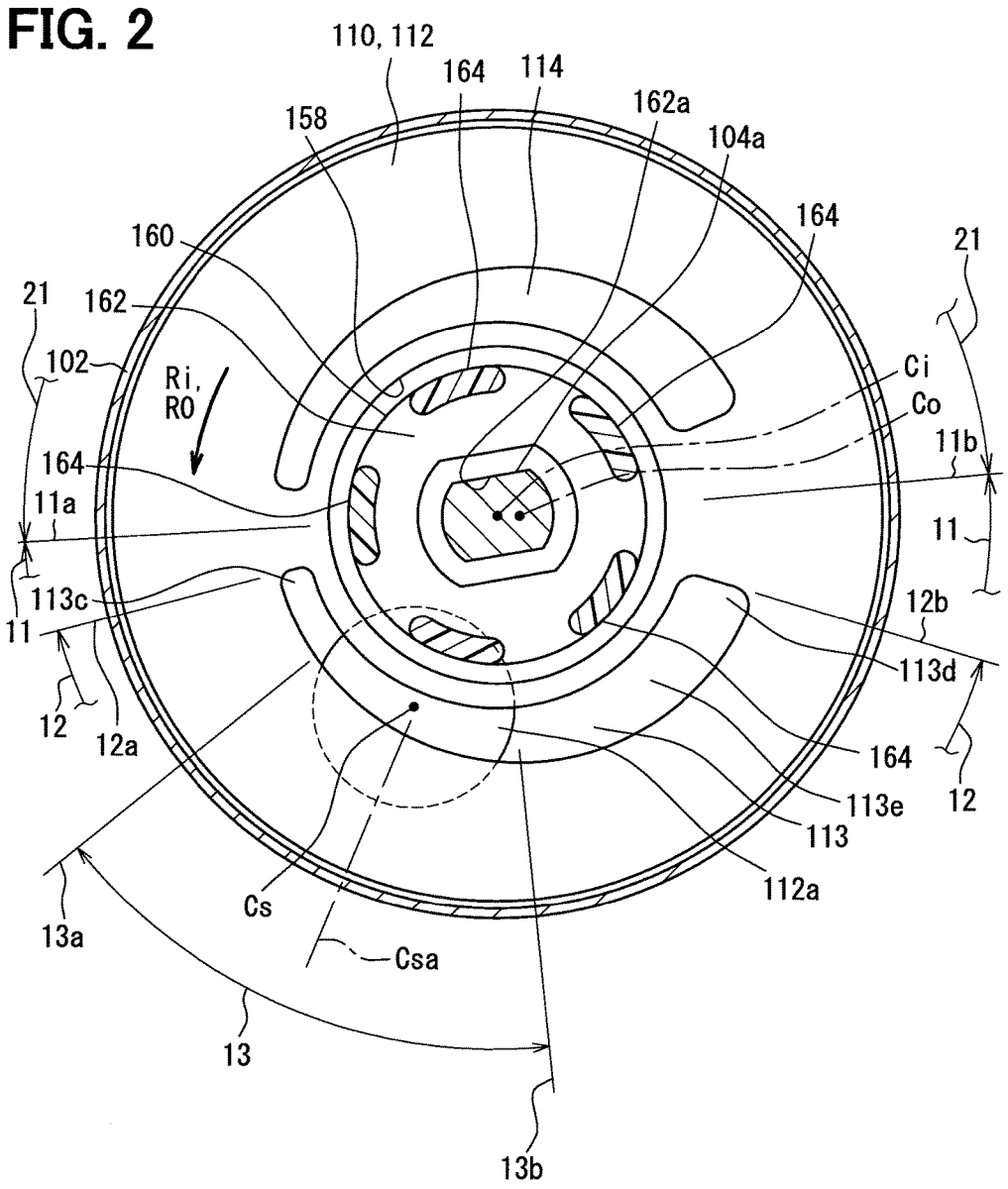
FIG. 2 is a cross-sectional view taken along line II-II in FIG. 1.

In order to draw the fuel from an outside of the fluid pump 101, the pump cover 112 shown in FIGS. 1 and 2 has a suction passage 112*a*, which is formed as a cylindrical hole, and a suction groove 113, which is shaped into an arcuate form. In the pump cover 112, the suction passage 112*a* is communicated with the suction groove 113 at a predetermined opening location Ss, which is eccentric from a central axis (hereinafter referred to as an inner central axis) Ci of the inner rotor 120. The suction groove 113 is axially grooved, i.e., formed in an inside wall surface of the pump cover 112 and opens on the pump casing 116 side of the pump cover 112. A communicating portion of the suction groove 113, which is communicated with the suction passage 112*a*, extends through the pump cover 112 in the axial direction. A non-communicating portion of the suction groove 113, which is not directly communicated with the suction passage 112*a*, is shaped into a cup form having a bottom. As shown in FIG. 2, the suction groove 113 has a circumferential extent, which is less than one half (less than 180 degrees) of an entire circumference of the inner rotor 120 in the rotational direction Ri (also see FIG. 4).

The suction groove 113 extends from a start end part 113*c* to a terminal end part 113*d* in the rotational direction Ri, Ro such that a radial extent (hereinafter referred to as a width) of the suction groove 113, which is measured in a radial direction of the rotational axis, progressively increases in the rotational direction Ri, Ro from the start end part 113*c* to the terminal end part 113*d*. The suction passage 112*a* opens in a groove bottom portion 113*e* of the suction groove 113 at the opening area Ss, so that the suction groove 113 is communicated with the suction passage 112*a*. As shown particularly in FIG. 2, in an entire range of the opening area Ss, in which the suction passage 112*a* opens, the width of the suction groove 113 is smaller than a width (diameter) of the suction passage 112*a*.

Furthermore, the pump cover 112 forms an installation space 158 at an area that is opposed to the inner rotor 120 along the inner central axis Ci. The installation space 158 is shaped into a recessed hole. A main body 162 of the joint member 160 is rotatably installed in the installation space 158.

Figure 3:
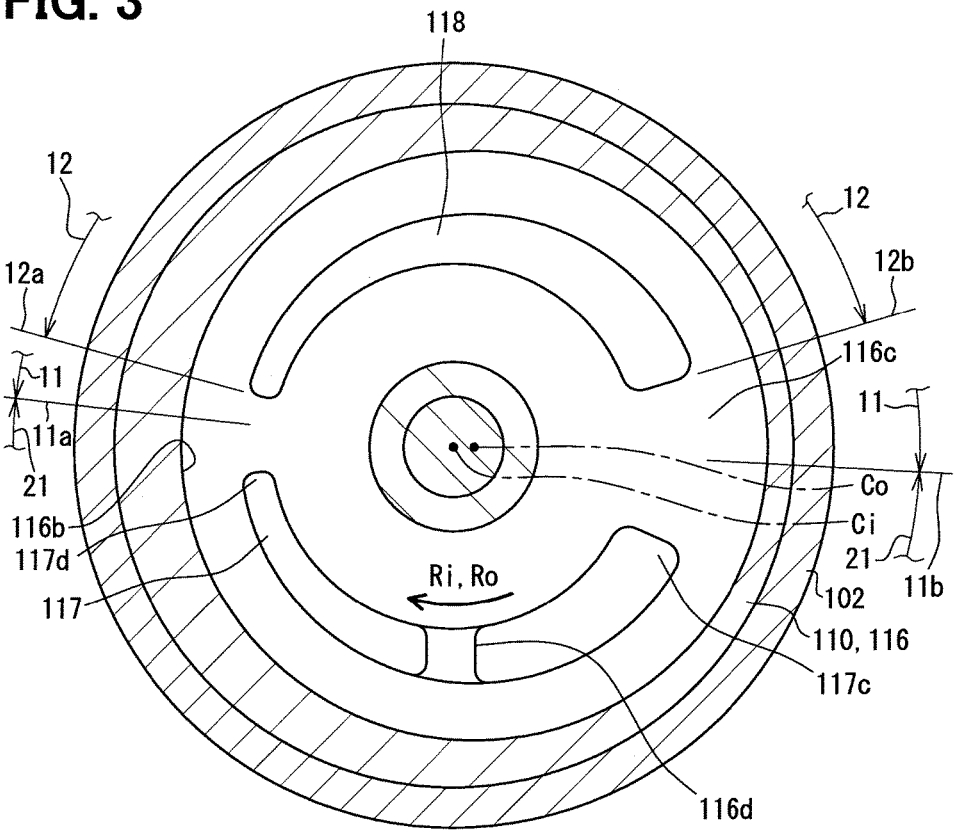
FIG. 3 is a cross-sectional view taken along line in FIG. 1.

The pump casing 116 shown in FIGS. 1, 3, 4 and 5 is made of metal and is shaped into a cylindrical tubular form having a bottom. An opening portion 116*a* of the pump casing 116 is covered with the pump cover 112 such that an entire circumferential extent of the opening portion 116*a* is tightly closed by the pump cover 112. As shown particularly in FIGS. 1 and 4, an inner peripheral portion 116*b* of the pump casing 116 is formed as a cylindrical hole that is eccentric relative to the inner central axis Ci of the inner rotor 120. The pump casing 116 forms a discharge passage 117, which is formed as an arcuate hole, to discharge the fuel from the discharge port 105*b* through a high pressure passage 106 defined between the pump body 102 and the electric motor 104. The discharge passage 117 axially extends through a recessed bottom portion 116*c* of the pump casing 116. Particularly, as shown in FIG. 3, the discharge passage 117 has a circumferential extent, which is less than one half (i.e., less than 180 degrees) of the entire circumference of the inner rotor 120 in the rotational direction Ri. A radial extent (hereinafter referred to as a width) of the discharge passage 117, which is measured in the radial direction, progressively decreases in the rotational direction Ri, Ro from a start end part 117*c* to a terminal end part 117*d*.

Furthermore, the pump casing 116 includes a reinforcing rib 116*d* in the discharge passage 117. The reinforcing rib 116*d* is formed integrally with the pump casing 116 such that the reinforcing rib 116*d* extends across the discharge passage 117 in a crossing direction, which crosses the rotational direction Ri of the inner rotor 120, and thereby the reinforcing rib 116*d* reinforces the pump casing 116.

An opposing suction groove 118 shown in FIG. 3 is formed in the recessed bottom portion 116*c* of the pump casing 116 at a corresponding area that is opposed to the suction groove 113 in the axial direction while pump chambers 140 (described later in detail) are interposed between the opposing suction groove 118 and the suction groove 113 in the axial direction. The opposing suction groove 118 is an arcuate groove that corresponds to a shape, which is produced by projecting the suction groove 113 onto the pump casing 116 in the axial direction. In this way, in the pump casing 116, the discharge passage 117 is formed to be symmetric to the opposing suction groove 118 with respect to the symmetry axis located between the discharge passage 117 and the opposing suction groove 118. As shown particularly in FIG. 2, an opposing discharge groove 114 is formed in the pump cover 112 at a corresponding area that is opposed to the discharge passage 117 in the axial direction while the pump chambers 140 are interposed between the opposing discharge groove 114 and the discharge passage 117 in the axial direction. The opposing discharge groove 114 is formed as an arcuate groove that is shaped to correspond with a shape, which is produced by projecting the discharge passage 117 onto the pump cover 112 in the axial direction. In this way, in the pump cover 112, the suction groove 113 is formed to be symmetric to the opposing discharge groove 114 with respect to the symmetry axis located between the suction groove 113 and the opposing discharge groove 114. An outline (contour) of the suction groove 113, an outline (contour) of the opposing discharge groove 114, an outline (contour) of the discharge passage 117, and an outline (contour) of the opposing suction groove 118 are shaped to extend in parallel with a rotational path of the external teeth 124*a* and a rotational path of the internal teeth 132*a*.

As shown in FIG. 1, a radial bearing 150 is securely fitted to the recessed bottom portion 116*c* of the pump casing 116 along the inner central axis Ci to radially support the rotatable shaft 104*a* of the electric motor 104 in a manner that enables rotation of the rotatable shaft 104*a*. Furthermore, a thrust bearing 152 is securely fitted to the pump cover 112 along the inner central axis Ci to axially support the rotatable shaft 104*a* in a manner that enables the rotation of the rotatable shaft 104*a*.

Figure 4:
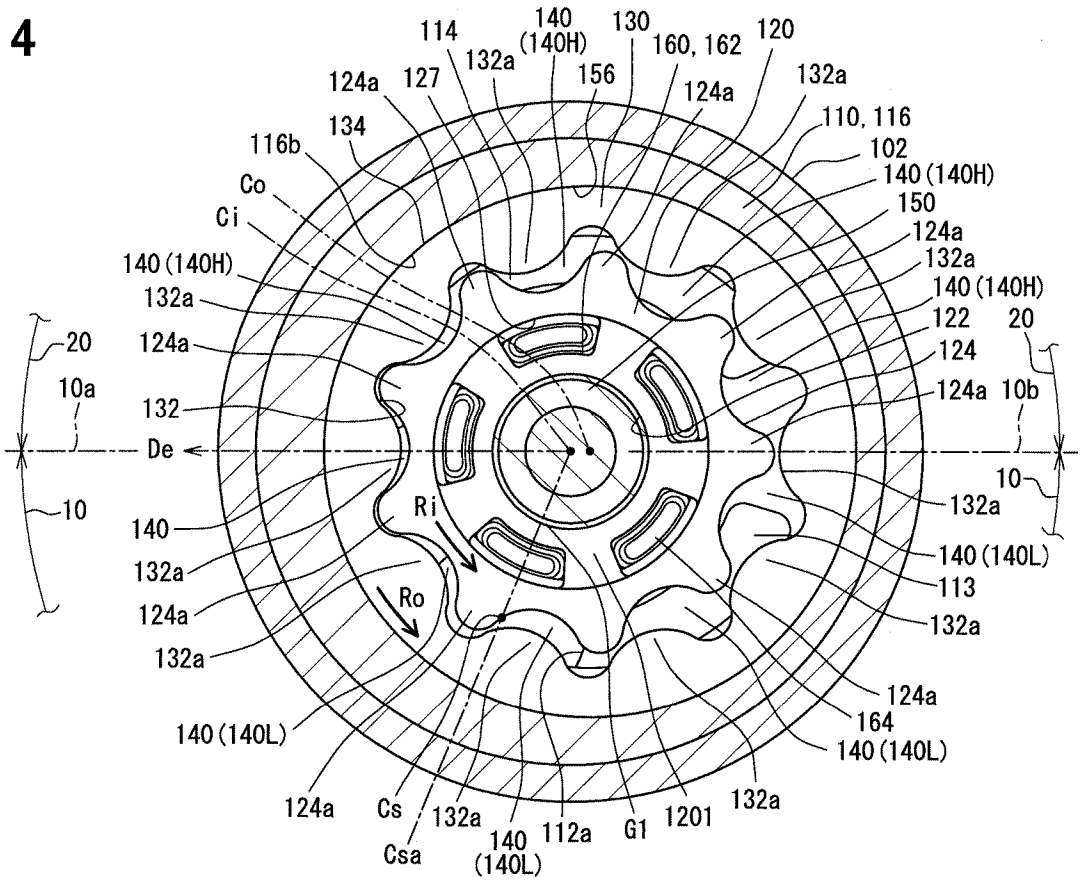
FIG. 4 is a cross-sectional view taken along line IV-IV in FIG. 1.

As shown in FIGS. 1 and 4, a receiving space 156, which receives the inner rotor 120 and the outer rotor 130, is formed by the recessed bottom portion 116*c* and the inner peripheral portion 116*b* of the pump casing 116 and the pump cover 112.

The inner rotor 120, which is indicated in FIGS. 1 and 4, is centered at the inner central axis Ci and is thereby coaxial with the rotatable shaft 104*a* (i.e., coaxial with a rotational axis of the rotatable shaft 104*a*), so that the inner rotor 120 is eccentrically placed in the receiving space 156. An inner peripheral portion 122 of the inner rotor 120 is radially supported by the radial bearing 150, and two slide surfaces 125 of the inner rotor 120, which are respectively formed at two opposed axial ends of the inner rotor 120, are supported by the recessed bottom portion 116*c* of the pump casing 116 and the pump cover 112, respectively, in a manner that enables rotation of the inner rotor 120.

The inner rotor 120 has a plurality of insertion holes 127 that extend in the axial direction at a corresponding area of the inner rotor 120, which is opposed to the installation space 158. In the present embodiment, the number of the insertion holes 127 is five, and these insertion holes 127 are arranged one after another at equal intervals in the circumferential direction along the rotational direction Ri. The insertion holes 127 extend through the inner rotor 120 from the installation space 158 side to the recessed bottom portion 116*c* side in the axial direction. Legs (projections) 164 of the joint member 160 are inserted into the insertion holes 127, respectively, so that the drive force of the rotatable shaft 104*a* is transmitted to the inner rotor 120 through the joint member 160. Thereby, the inner rotor 120 is rotated in the circumferential direction about the inner central axis Ci in response to the rotation of the rotatable shaft 104*a* of the electric motor 104 while the slide surfaces 125 of the inner rotor 120 are slid along the recessed bottom portion 116*c* and the pump cover 112, respectively.

The inner rotor 120 includes a plurality of external teeth 124*a*, which are formed in an outer peripheral portion 124 of the inner rotor 120 and are arranged one after another at equal intervals in the circumferential direction along the rotational direction Ri. Each of the external teeth 124*a* can axially oppose the suction groove 113, the discharge passage 117, the opposing discharge groove 114 and the opposing suction groove 118 in response to the rotation of the inner rotor 120. Thereby, it is possible to limit sticking of the inner rotor 120 to the recessed bottom portion 116*c* and the pump cover 112.

As shown in FIGS. 1 and 4, the outer rotor 130 is eccentric to the inner central axis Ci of the inner rotor 120, so that the outer rotor 130 is coaxially received in the receiving space 156. In this way, the inner rotor 120 is eccentric to, i.e., is decentered from the outer rotor 130 in an eccentric direction De, which is the radial direction. An outer peripheral portion 134 of the outer rotor 130 is radially supported by the inner peripheral portion 116*b* of the pump casing 116 in a manner that enables rotation of the outer rotor 130. Furthermore, the outer peripheral portion 134 of the outer rotor 130 is axially supported by the recessed bottom portion 116*c* of the pump casing 116 and the pump cover 112 in a manner that enables the rotation of the outer rotor 130. The outer rotor 130 is rotatable in the rotational direction (certain rotational direction) Ro about an outer central axis Co, which is eccentric to the inner central axis Ci.

The outer rotor 130 has a plurality of internal teeth 132*a* for meshing with the external teeth 124*a* of the inner rotor 120. The internal teeth 132*a* are formed in an inner peripheral portion 132 of the outer rotor 130 and are arranged one after another at equal intervals in the rotational direction Ro. Each of the internal teeth 132*a* can axially oppose the suction groove 113, the discharge passage 117, the opposing discharge groove 114 and the opposing suction groove 118 in response to the rotation of the outer rotor 130. Thereby, it is possible to limit sticking of the outer rotor 130 to the recessed bottom portion 116*c* and the pump cover 112.

A fuel pressure (discharge pressure) in an inside of the discharge passage 117 is axially exerted against the inner rotor 120 and the outer rotor 130 toward the suction passage 112*a*. A fuel pressure in the opposing discharge groove 114 is also the discharge pressure and is axially exerted against the inner rotor 120 and the outer rotor 130 toward the electric motor 104 side. Since the opposing discharge groove 114 is axially opposed to the discharge passage 117, the fuel pressure of the opposing discharge groove 114 and the fuel pressure of the discharge passage 117 are balanced with each other. Therefore, it is possible to limit tilting of the inner rotor 120 and the outer rotor 130, which would be otherwise caused by the discharge pressure.

Similarly, since the opposing suction groove 118 is axially opposed to the suction groove 113, the fuel pressure (the suction pressure) of the opposing suction groove 118 and the fuel pressure (the suction pressure) of the suction groove 113 are balanced with each other. Therefore, it is possible to limit tilting of the inner rotor 120 and the outer rotor 130, which would be otherwise caused by the suction pressure. The external teeth 124*a* and the internal teeth 132*a* are shaped to have a trochoid tooth profile. The number of the internal teeth 132*a* is set to be larger than the number of the external teeth 124*a* by one. The inner rotor 120 is meshed with the outer rotor 130 due to the eccentricity in the eccentric direction De. In this way, the pump chambers 140 are radially formed between the internal teeth 132*a* and the external teeth 124*a* in the receiving space 156. A volume of each pump chamber 140 is increased and decreased through the rotation of the outer rotor 130 and the rotation of the inner rotor 120.

The volume of each of opposing ones of the pump chambers 140, which are axially opposed to and communicated with the suction groove 113 and the opposing suction groove 118, is increased in response to the rotation of the inner rotor 120 and the rotation of the outer rotor 130. Thereby, the fuel is drawn from the suction passage 112*a* into the corresponding pump chambers 140 through the suction groove 113. At this time, since the width (radial extent) of the suction groove 113 progressively increases from the start end part 113*c* to the terminal end part 113*d* in the rotational direction Ri, Ro (also see FIG. 2), the amount of fuel drawn into the pump chamber 140 through the suction groove 113 corresponds to the amount of increase in the volume of the pump chamber 140. The corresponding ones of the pump chambers 140, each of which draws the fuel by increasing its volume in the above-described manner, are referred to as negative pressure portions (or negatively pressurized pump chambers) 140L.

The volume of each of opposing ones of the pump chambers 140, which are axially opposed to and communicated with the discharge passage 117 and the opposing discharge groove 114, is decreased in response to the rotation of the inner rotor 120 and the rotation of the outer rotor 130. Therefore, simultaneously with the suctioning function discussed above, the fuel is discharged from the corresponding pump chamber 140 into the high pressure passage 106 through the discharge passage 117. At this time, since the width (radial extent) of the discharge passage 117 progressively decreases from the start end part 117*c* to the terminal end part 117*d* in the rotational direction Ri, Ro (also see FIG. 3), the amount of fuel discharged from the pump chamber 140 through the discharge passage 117 corresponds to the amount of decrease in the volume of the pump chamber 140. The corresponding ones of the pump chambers 140, each of which compresses the fuel by decreasing its volume in the above-described manner, are referred to as high pressure portions (or highly pressurized pump chambers or positively pressurized pump chambers) 140H.

The joint member 160 is made of synthetic resin, such as poly phenylene sulfide (PPS). The joint member 160 relays the rotatable shaft 104*a* to the inner rotor 120 to rotate the inner rotor 120 in the circumferential direction. The joint member 160 includes the main body 162 and the legs 164.

The main body 162 is installed in the installation space 158, which is formed in the pump cover 112. A fitting hole 162*a* is formed in a center of the main body 162, and thereby the main body 162 is shaped into a circular ring form. When the rotatable shaft 104*a* is fitted into the fitting hole 162*a*, the main body 162 is securely fitted to the rotatable shaft 104*a* to rotate integrally with the rotatable shaft 104*a*.

The number of the legs 164 corresponds to the number of the insertion holes 127 of the inner rotor 120. Specifically, in order to reduce or minimize the influence of the torque ripple of the electric motor 104, the number of the legs 164 is different from the number of the magnetic poles and the number of the slots of the electric motor 104 and is thereby set to five (5), which is a prime number, in the present embodiment. The legs 164 axially extend from a plurality of locations (five locations in the present embodiment), respectively, on a radially outer side of the fitting hole 162*a*, which is a fitting location of the main body 162. The legs 164 are arranged one after another at equal intervals in the circumferential direction. Each leg 164 is resiliently deformable because of the resilient material and the axially elongated shape of the leg 164. When the rotatable shaft 104*a* is rotated, each leg 164 is flexed through the resilient deformation thereof in conformity with the corresponding insertion hole 127. Thereby, the leg 164 contacts an inner wall of the insertion hole 127 while absorbing circumferential dimensional errors of the insertion hole 127 and the leg 164 generated at the manufacturing. In this way, the joint member 160 transmits the drive force of the rotatable shaft 104*a* to the inner rotor 120 through the legs 164.

Next, with reference to FIGS. 5 to 7, a structure of the radial bearing 150 will be described in detail.

Figure 5:
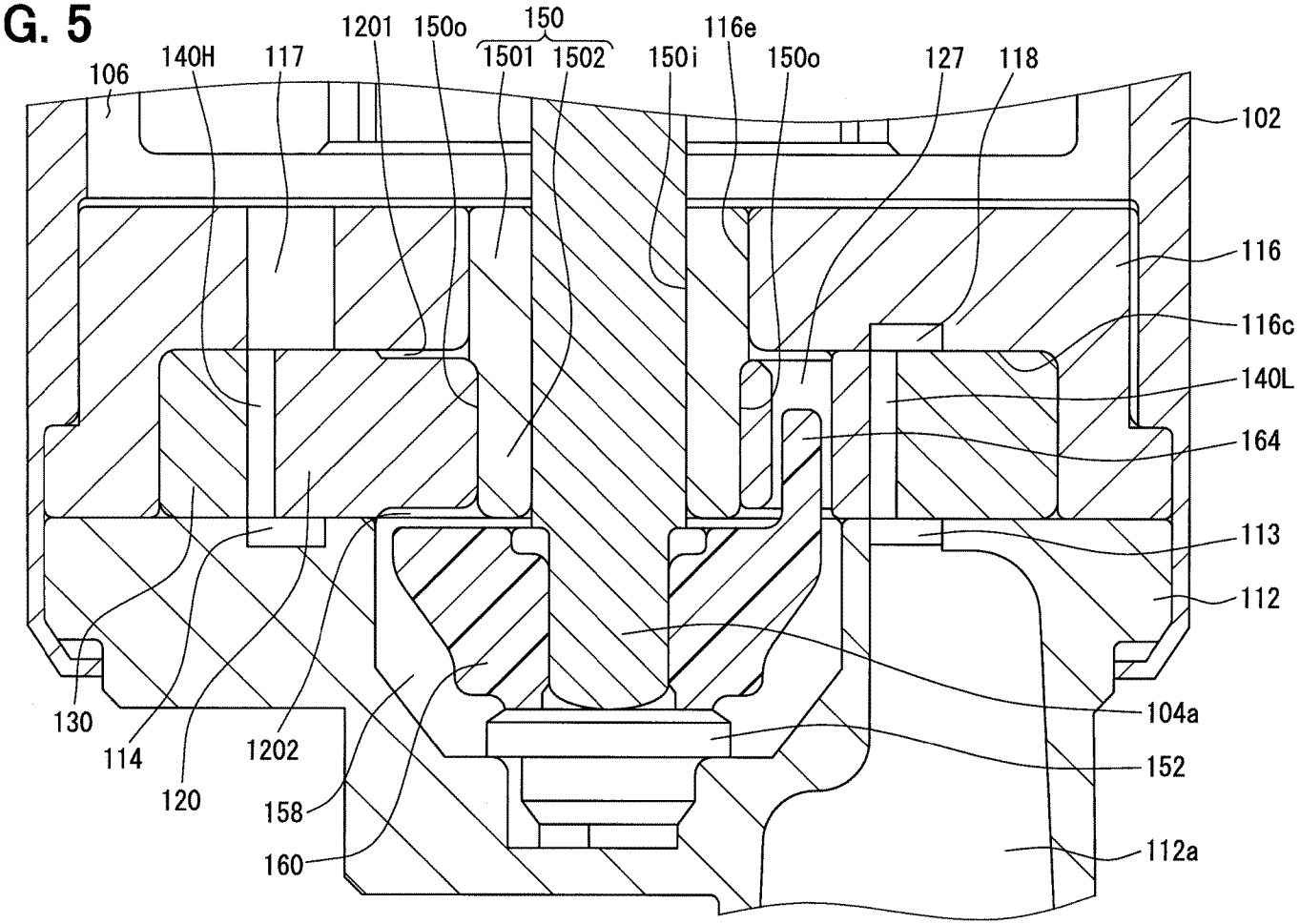
FIG. 5 is a partial enlarged view of FIG. 1.

As shown in FIG. 5, the radial bearing 150 is shaped into a cylindrical tubular form. The radial bearing 150 is made of metal and is coated with resin. The rotatable shaft 104*a* is inserted into the inside of the radial bearing 150 such that a cylindrical inner peripheral surface 150*i* of the radial bearing 150 rotatably and slidably supports the rotatable shaft 104*a*.

An axial portion of the radial bearing 150, which is located on the pump cover 112 side in the axial direction, will be referred to as a slide portion 1502. Furthermore, another axial portion of the radial bearing 150, which is located on the pump casing 116 side in the axial direction, will be referred to as a seal portion 1501. An inner diameter of an axial portion of the cylindrical inner peripheral surface 150*i*, which is located in the slide portion 1502, is equal to an inner diameter of an axial portion of the cylindrical inner peripheral surface 150*i*, which is located in the seal portion 1501. In contrast, an outer diameter of an axial portion of a cylindrical outer peripheral surface 150*o*, which is located in the seal portion 1501, is larger than an outer diameter of an axial portion of the cylindrical outer peripheral surface 150*o*, which is located in the slide portion 1502.

The slide portion 1502 is inserted into the inside of the inner rotor 120, which is shaped into the cylindrical tubular form, such that the cylindrical outer peripheral surface 150*o* of the slide portion 1502 rotatably and slidably supports the inner rotor 120. The seal portion 1501 is securely press fitted into a through-hole 116*e* of the pump casing 116. The radial bearing 150 is non-rotatably fixed to the pump casing 116 through this pressing fitting. The outer peripheral surface of the seal portion 1501 tightly contacts the inner peripheral surface of the through-hole 116*e* to seal between the inner peripheral surface of the through-hole 116*e* and the cylindrical outer peripheral surface 150*o*.

An axial location of an end surface of the slide portion 1502 coincides with an axial location of an end surface of the pump casing 116, which contacts the pump cover 112. Furthermore, an axial location of an end surface of the seal portion 1501 coincides with an axial location of a wall surface of the pump casing 116, which forms the high pressure passage 106. In other words, an axial length of the pump casing 116 coincides with an axial length of the radial bearing 150.

Figure 6:
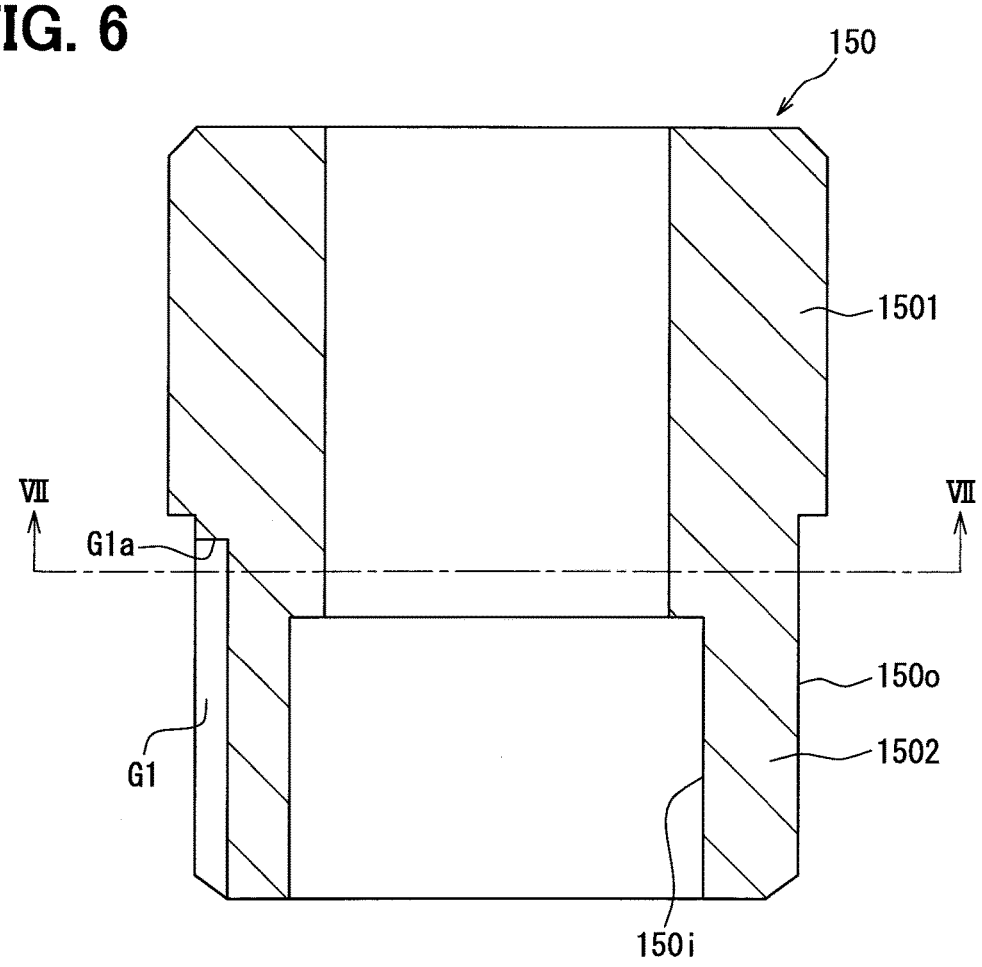
FIG. 6 is a cross-sectional view of a radial bearing shown in FIG. 5.
Figure 7:
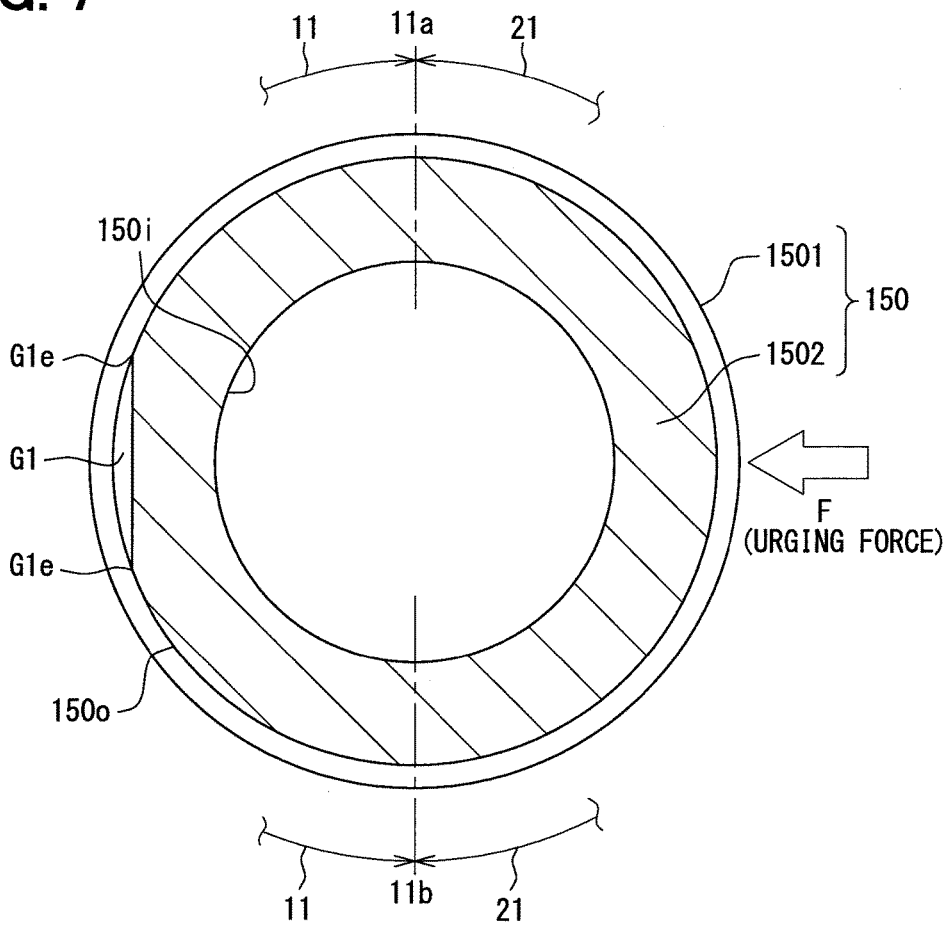
FIG. 7 is a cross-sectional view taken along line VII-VII in FIG. 6.

As shown in FIGS. 4, 6 and 7, a lubrication groove G1, which accumulates the fuel, is formed in the cylindrical outer peripheral surface 150*o* of the radial bearing 150. The lubrication groove G1 is located in the portion of the cylindrical outer peripheral surface 150*o*, which forms the slide portion 1502 and is displaced from the seal portion 1501. The lubrication groove G1 is shaped such that the lubrication groove G1 extends from the end surface of the slide portion 1502 toward the seal portion 1501 in the axial direction (see FIG. 6). The lubrication groove G1 is formed by cutting a portion of the slide portion 1502 in a cutting process such that the portion of the cylindrical outer peripheral surface 150*o* is cut and is thereby radially inwardly recessed (see FIG. 7).

The high pressure fuel of the high pressure passage 106 penetrates into an area (slide surface) between the cylindrical inner peripheral surface 150*i* of the radial bearing 150 and the outer peripheral surface of the rotatable shaft 104*a* and thereafter leaks from this area (slide surface) into the installation space 158 after dropping of the pressure of the high pressure fuel in this area (slide surface). Therefore, the installation space 158 accumulates the fuel (intermediate pressure fuel) that has the pressure, which is lower than the pressure of the high pressure fuel of the high pressure passage 106 and is higher than the pressure of the fuel (suction fuel) of the suction passage 112*a*.

As shown in FIGS. 4 and 5, a first groove 1201 is formed in a surface of the inner rotor 120, which is axially opposed to the pump casing 116. The first groove 1201 is shaped into a ring form (annular form) and circumferentially extends about the radial bearing 150. Furthermore, a second groove 1202 is formed in an opposite surface of the inner rotor 120, which is axially opposite from the pump casing 116. The second groove 1202 is shaped into a ring form (annular form) and circumferentially extends about the radial bearing 150. An outer diameter of the second groove 1202 is the same as an outer diameter of the first groove 1201.

The high pressure fuel of the discharge passage 117 penetrates into an area (slide surface) between the inner rotor 120 and the pump casing 116 and thereafter leaks form this area (slide surface) into the first groove 1201 after dropping of the pressure of the high pressure fuel in this area (slide surface). Therefore, the first groove 1201 accumulates the fuel (intermediate pressure fuel) that has the pressure, which is lower than the pressure of the high pressure fuel of the high pressure passage 106 and is higher than the pressure of the fuel (suction fuel) of the suction passage 112*a*. The second groove 1202 is filled with the intermediate pressure fuel of the installation space 158. Since both of the first groove 1201 and the second groove 1202 are shaped into the ring form and have the same outer diameter, the pressure (the intermediate pressure) of the fuel accumulated in the first groove 1201 and the pressure (the intermediate pressure) of the fuel accumulated in the second groove 1202 are balanced with each other. Therefore, it is possible to limit tilting of the inner rotor 120, which would be otherwise caused by the intermediate pressure fuel.

As discussed above, the fuel accumulated in the first groove 1201 and the fuel accumulate in the second groove 1202 have the identical pressure (the intermediate pressure). Therefore, penetration of the fuel into the area (slide surface) between the cylindrical outer peripheral surface 150*o* of the radial bearing 150 and the inner peripheral surface of the inner rotor 120 is less probable in comparison to the penetration of the high pressure fuel into the cylindrical inner peripheral surface 150*i*. However, since the lubrication groove G1, which accumulates the fuel, is formed in the cylindrical outer peripheral surface 150*o*, the intermediate pressure fuel can relatively easily penetrate into the lubrication groove G1.

Next, a location of the lubrication groove G1 will be described in detail with reference to FIGS. 2 to 4.

With reference to FIGS. 2 and 3, a region of the pump housing 110, in which the corresponding ones of the pump chambers 140 suction the fuel (i.e., a region, in which the corresponding ones of the pump chambers 140 function as the negative pressure portions 140L), is defined as a suction region 11. Furthermore, another region of the pump housing 110, in which the corresponding ones of the pump chambers 140 compress the fuel (i.e., a region, in which the corresponding ones of the pump chambers 140 function as the high pressure portions 140H), is defined as a compression region 21. Each of two boundary lines 11*a*, 11*b* between the suction region 11 and the compression region 21 is a straight line that connects between a corresponding halfway point, which is circumferentially located between the opposing discharge groove 114 and the suction groove 113, and the inner central axis Ci. Specifically, the boundary line 11*a* is the straight line that radially connects between the left side halfway point, which is circumferentially located between the opposing discharge groove 114 and the suction groove 113 at the left side thereof in FIG. 2, and the inner central axis Ci. The boundary line 11*b* is the straight line that radially connects between the right side halfway point, which is circumferentially located between the opposing discharge groove 114 and the suction groove 113 at the right side thereof in FIG. 2, and the inner central axis Ci.

The lubrication groove G1 is located in a rotational angular range, throughout which the suction region 11 is present, in the rotational direction (see FIG. 7). That is, the lubrication groove G1 is located in the angular extent of the suction region 11 in the rotational direction. For example, it is desirable that the lubrication groove G1 is entirely placed in this rotational angular range. More specifically, the lubrication groove G1 is located on a maximum negative pressure line Csa, which connects between a suction center line Cs of the suction passage 112*a* and the inner central axis Ci. For example, a circumferential center part of the lubrication groove G1, which is centered in the circumferential direction (the rotational direction), is located on the maximum negative pressure line Csa (see FIGS. 2 and 4).

Now, advantages of the present embodiment will be described.

In the case where the temperature of the fuel is low, the viscosity of the fuel is increased. Particularly, in the case where the fuel is the light oil, the viscosity of the fuel becomes very high. Therefore, in such a case, a reaction force, which is applied from the fuel to the inner rotor 120, is increased. This reaction force is not uniformly applied to the entire inner rotor 120. Thus, the reaction force is applied to the inner rotor 120 as a force (tilting force) that is exerted to tilt the inner rotor 120 relative to the rotatable shaft 104*a* (the rotational axis of the rotatable shaft 104*a*). As a result, if the joint member 160 is eliminated from the fluid pump 101 unlike the present embodiment to directly engage the rotatable shaft 104*a* to the inner rotor 120, the tilting force is directly applied to the rotatable shaft 104*a*. Thus, the slide resistance between the radial bearing 150 and the rotatable shaft 104*a* is increased to cause an increase in the energy loss or generation of damage at the sliding portion between the radial bearing 150 and the rotatable shaft 104*a*.

With respect to the above-described disadvantage, according to the present embodiment, the inner rotor 120 is coupled to the rotatable shaft 104*a* through the joint member 160, so that the above-described tilting force is absorbed through the resilient deformation of the joint member 160, and thereby the slide resistance between the radial bearing 150 and the rotatable shaft 104*a* is reduced.

Furthermore, according to the present embodiment, the rotatable shaft 104*a* is placed to extend over both of the inside of the pump housing 110 and the high pressure passage 106. Therefore, the high pressure fuel of the high pressure passage 106 can penetrate into the area between the cylindrical inner peripheral surface 150*i* of the radial bearing 150 and the rotatable shaft 104*a* to perform its lubricating function, so that the slide resistance of the rotatable shaft 104*a* can be sufficiently reduced.

Furthermore, the lubrication groove G1 is formed in the cylindrical outer peripheral surface 150*o* of the radial bearing 150, and the lubrication groove G1 accumulates the intermediate pressure fuel that is present in the pump housing 110. Therefore, the intermediate pressure fuel, which is accumulated in the lubrication groove G1, can leak from the lubrication groove G1 in the circumferential direction along the cylindrical outer peripheral surface 150*o* and can enter the area (slide surface) between the cylindrical outer peripheral surface 150*o* and the inner rotor 120 to perform the lubricating function therebetween. Thus, the slide resistance of the inner rotor 120 can be sufficiently reduced.

In this type of fluid pump 101, it is identified which ones of the pump chambers 140 function as the high pressure portions 140H and which ones of the pump chambers 140 function as the negative pressure portions 140L. Therefore, the corresponding ones of the pump chambers 140, which are located in the corresponding predetermined area in the rotational direction, function as the high pressure portions 140H, and the other corresponding ones of the pump chambers 140, which are located in the other corresponding predetermined area in the rotational direction, function as the negative pressure portions 140L. That is, the predetermined area in the rotational direction becomes the compression region 21, and the other predetermined area in the rotational direction becomes the suction region 11. For example, in the case of FIG. 5, the right half side area (the pump chambers 140 located at the right side), which is located on the right side of the rotatable shaft 104*a*, always functions as the negative pressure portions 140L (the suction region 11), and the left half side area (the pump chambers 140 located at the left side), which is located on the left side of the rotatable shaft 104*a*, always functions as the high pressure portions 140H (the compression region 21). For example, in the case of FIG. 4, the lower half side area (the pump chambers 140 located at the lower side), which is located on the lower side of the rotatable shaft 104*a*, always functions as the negative pressure portions 140L (the suction region 11), and the upper half side area (the pump chambers 140 located at the upper side), which is located on the upper side of the rotatable shaft 104*a*, always functions as the high pressure portions 140H (the compression region 21).

The fuel pressure is applied to the inner rotor 120 from the high pressure portions 140H (the compression region 21) toward the negative pressure portions 140L (the suction region 11) in the radial direction of the rotational axis. Therefore, the fuel pressure is always continuously applied in the same direction, i.e., the direction from the compression region 21 side toward the suction region 11 side. Thus, as shown in FIG. 7, an urging force F is always applied from the inner rotor 120 to the radial bearing 150 in the direction that is from the compression region 21 toward the suction region 11.

In the present embodiment, which is made in view of the above point, the lubrication groove G1 is present in the rotational angular range, throughout which the suction region 11 is present, in the rotational direction. Thereby, it is possible to avoid concentration of the urging force F to edges G1*e* of the lubrication groove G1. Thus, it is possible to limit an increase in the slide resistance in the cylindrical outer peripheral surface 150*o*, which would be caused by the formation of the lubrication groove G1. Furthermore, since the urging force F is not exerted in the rotational angular range of the cylindrical outer peripheral surface 150*o*, in which the suction region 11 is present, a small gap is formed between the inner rotor 120 and the cylindrical outer peripheral surface 150*o*. Thus, the fuel in the lubrication groove G1 can more easily leak from the lubrication groove G1 in the circumferential direction of the cylindrical outer peripheral surface 150*o*, and thereby the reliability of implementing the lubricating function can be improved.

Furthermore, in the present embodiment, since the lubrication groove G1 is located on the maximum negative pressure line Csa, the lubrication groove G1 is located in the location where the size of the above-described gap is maximized. Thus, the above-described advantage, which is implemented by the absence of the urging force F, can be maximized.

Furthermore, in the present embodiment, the lubrication groove G1 is located in the portion of the cylindrical outer peripheral surface 150*o*, which forms the slide portion 1502 and is displaced from the seal portion 1501. In this way, a seal length of the seal portion 1051 measured in the axial direction can be increased in comparison to the case where the lubrication groove is formed in a portion of the seal portion 1501. Thus, it is possible to limit leakage of the high pressure fuel of the high pressure passage 106 to the first groove 1201 through the cylindrical outer peripheral surface 150*o* of the radial bearing 150.

OTHER EMBODIMENTS

The present disclosure has been described with respect to the one embodiment. However, the present disclosure is not limited to the above embodiment, and the above embodiment may be modified in various ways within a principal of the present disclosure.

In the embodiment shown in FIG. 2, each of the boundary lines 11*a*, 11*b* between the suction region 11 and the compression region 21 is set to be the straight line that connects between the corresponding halfway point, which is between the opposing discharge groove 114 and the suction groove 113, and the inner central axis Ci. Alternatively, as shown in FIG. 4, each of boundary lines 10*a*, 10*b* between a suction region 10 and a compression region 20, which respectively correspond to the suction region 11 and the compression region 21 of the above embodiment (see FIG. 2), may be a straight line that extends parallel to the eccentric direction De and passes through the inner central axis Ci.

In the embodiment shown in FIG. 2 and the above modification (the suction region 10 and the compression region 20) shown in FIG. 4, the lubrication groove G1 is located on the maximum negative pressure line Csa. Alternatively, the lubrication groove G1 may be located at a location that is circumferentially displaced from the maximum negative pressure line Gsa as long as the lubrication groove G1 is located in the suction region 10, 11.

However, it is desirable that the lubrication groove G1 is located in a rotational angular range 12, throughout which the suction groove 113 is present, in the rotational direction to further improve the above-described advantage, which is implemented by the absence of the urging force F. That is, it is desirable that the lubrication groove G1 is located in the angular extent of the suction groove 113 in the rotational direction.

For example, it is desirable that the lubrication groove G1 is entirely received in this rotational angular range 12 (the angular extent of the suction groove 113). The rotational angular range 12, throughout which the suction groove 113 is present, is a range that is circumferentially defined between a line 12*a*, which connects between one circumferential end of the suction groove 113 and the inner central axis Ci, and a line 12*b*, which connects between the other circumferential end of the suction groove 113 (see FIG. 2).

Furthermore, it is desirable that the lubrication groove G1 is located in a rotational angular range 13, throughout which the suction passage 112*a* is present, in the rotational direction to further improve the above-described advantage, which is implemented by the absence of the urging force F. That is, it is desirable that the lubrication groove G1 is located in the angular extent of the suction passage 112*a* in the rotational direction. For example, it is desirable that the lubrication groove G1 is entirely received in this rotational angular range 13 (the angular extent of the suction passage 112*a*). The rotational angular range 13, throughout which the suction passage 112*a* is present, is a range that is circumferentially defined between a tangent line 13*a*, which is tangent to the suction passage 112*a* on one circumferential side of the suction passage 112*a* and extends through the inner central axis Ci, and a tangent line 13*b*, which is tangent to the suction passage 112*a* on the other circumferential side of the suction passage 112*a* and extends through the inner central axis Ci (see FIG. 2).

Figure 8:
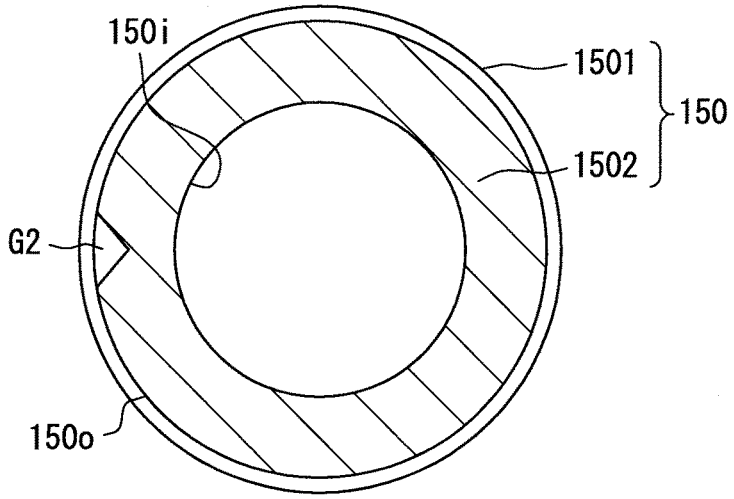
FIG. 8 is a cross-sectional view showing a modification of the radial bearing shown in FIG. 7.
Figure 9:
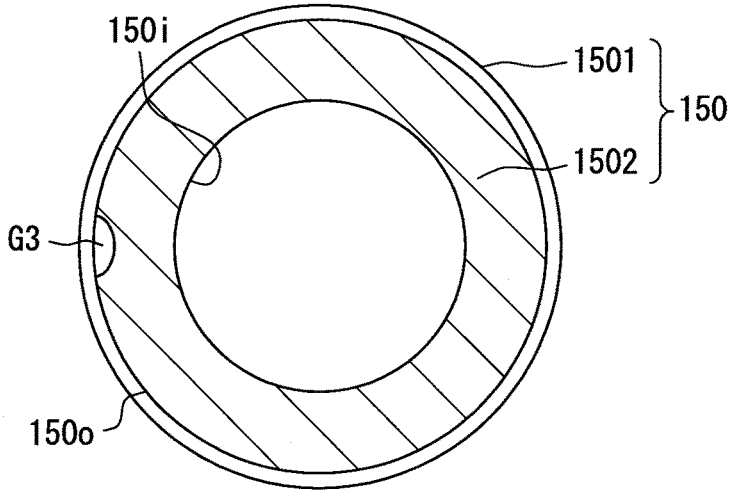
FIG. 9 is a cross-sectional view showing another modification of the radial bearing shown in FIG. 7.
Figure 10:
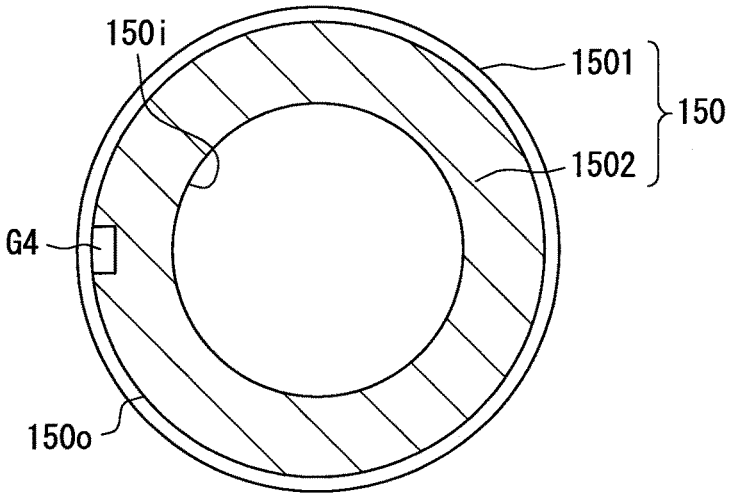
FIG. 10 is a cross-sectional view showing another modification of the radial bearing shown in FIG. 7.

In the embodiment shown in FIG. 7, the lubrication groove G1 has a planar cross-sectional shape. Alternative to the lubrication groove G1 of FIG. 7, as shown in FIG. 8, a lubrication groove G2, which has a triangular cross section, may be formed in the cylindrical outer peripheral surface 150*o* of the radial bearing 150. Further alternatively, as shown in FIG. 9, a lubrication groove G3, which has an arcuate cross section, may be formed in the cylindrical outer peripheral surface 150*o* of the radial bearing 150. Further alternatively, as shown in FIG. 10, a lubrication groove G4, which has a rectangular cross section, may be formed in the cylindrical outer peripheral surface 150*o* of the radial bearing 150.

Figure 11:
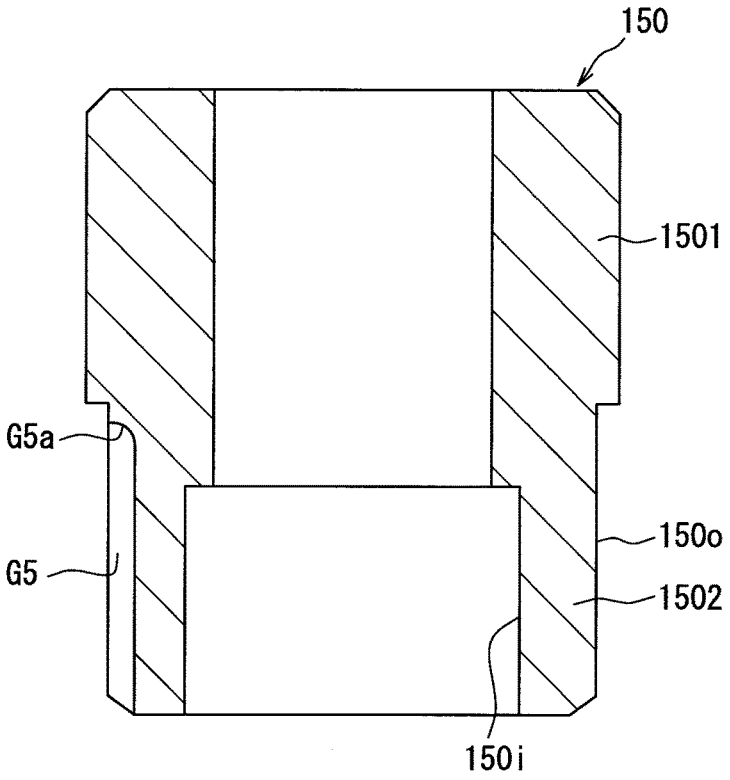
FIG. 11 is a cross sectional view showing a modification of the radial bearing shown in FIG. 6.
Figure 12:
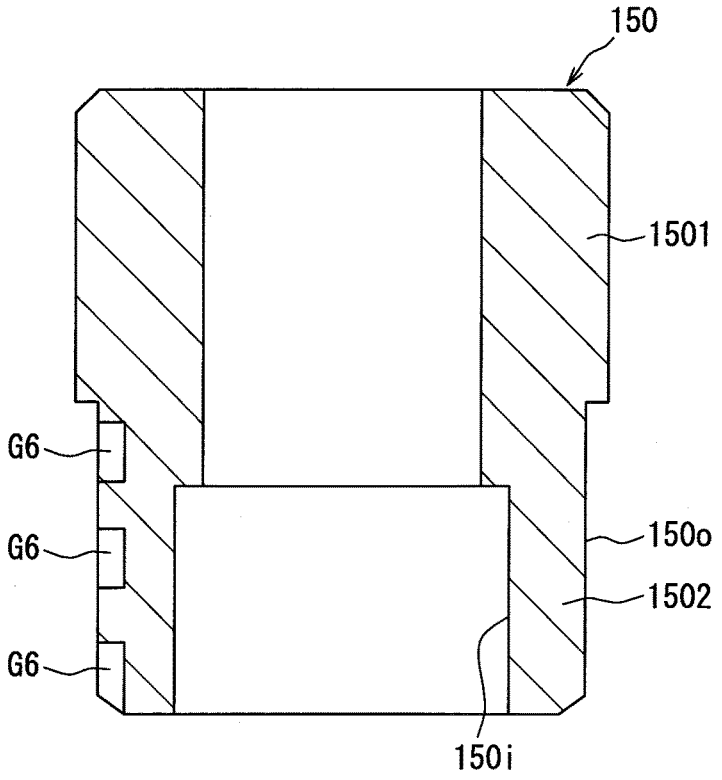
FIG. 12 is a cross sectional view showing another modification of the radial bearing shown in FIG. 6.

In the embodiment shown in FIG. 6, an end part G1*a* of the lubrication groove G1, which is axially opposite from the pump cover 112, is shaped into a right-angled edge. Alternatively, as shown in FIG. 11, the cylindrical outer peripheral surface 150*o* of the radial bearing 150 may have a lubrication groove G5, which has an end part G5*a* that is located on the axial side opposite from the pump cover 112 and is shaped into an arcuately curved form. Further alternatively, as shown in FIG. 12, the cylindrical outer peripheral surface 150*o* of the radial bearing 150 may have a plurality of lubrication grooves G6, which are arranged one after another in the axial direction.

Figure 13:
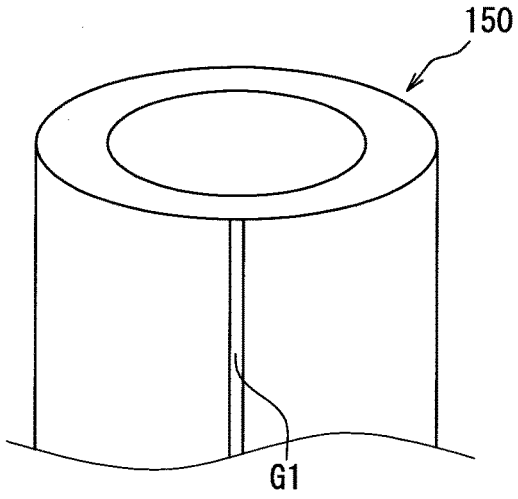
FIG. 13 is a partial perspective view showing a lubrication groove formed in the radial bearing shown in FIG. 6.
Figure 14:
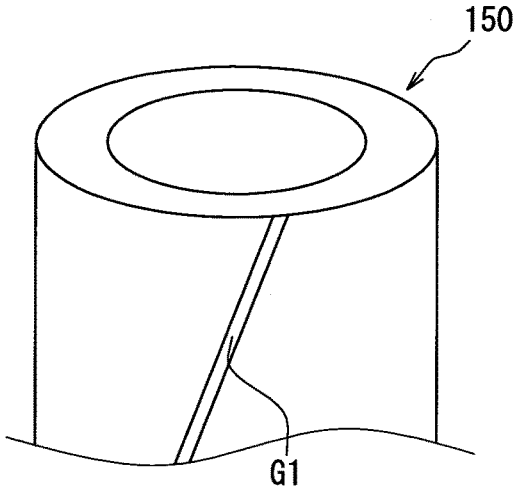
FIG. 14 is a partial perspective view showing a modification of the radial bearing shown in FIGS. 6 and 13.
Figure 15:
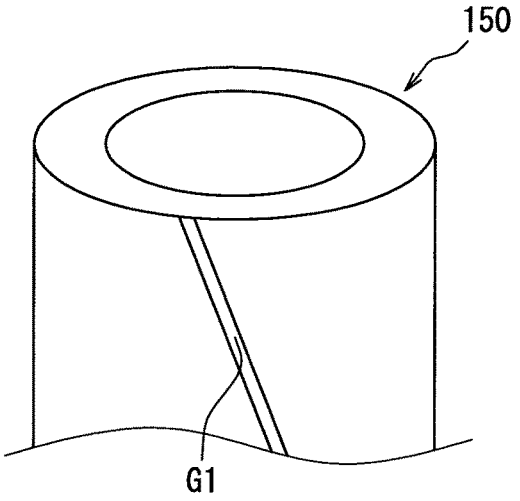
FIG. 15 is a partial perspective view showing another modification of the radial bearing shown in FIGS. 6 and 13.

In the embodiment shown in FIG. 6, the lubrication groove G1 is formed to extend in parallel with the axial direction, as shown in FIG. 13. Alternatively, as shown in FIGS. 14 and 15, the lubrication groove G1 may be formed to extend in a crossing direction that crosses the axial direction.

In the embodiment shown in FIG. 5, the radial bearing 150 is made of the metal and is coated with the resin. Alternatively, the radial bearing 150 may be made of the metal without the resin coating. Further alternatively, the radial bearing 150 may be made of resin.

In the embodiment shown in FIG. 4, the external teeth 124*a* and the internal teeth 132*a* are shaped to have the trochoid tooth profile. Alternatively, the external teeth 124*a* and the internal teeth 132*a* may be shaped to have any other suitable type of tooth profile, such as a cycloid tooth profile or a profile of a combination of various curved lines.

The subject fluid to be pumped with the fluid pump 101 is not limited to the light oil (diesel fuel) and may be any other liquid fuel, such as gasoline or alcohol. Furthermore, the subject fluid to be pumped with the fluid pump 101 is not limited to the fuel and may be liquid, such as hydraulic oil used in a hydraulic actuator or any of various lubricant oils. The fluid pump 101 is not limited to the fluid pump installed in the vehicle.

In the embodiment shown in FIG. 1, the present disclosure is implemented in the fluid pump 101 that has the pump main body 103 and the electric motor 104, which are integrated together. However, the electric motor 104 may not be provided in the fluid pump 101 of the present disclosure, and the electric motor 104 may be formed separately from the rest of the fluid pump 101. In the embodiment shown in FIG. 1, the inner rotor 120 is driven by the electric motor 104. Alternatively, the inner rotor 120 may be driven to rotate by a portion of a drive force for driving the vehicle, such as a drive force of a crankshaft of an internal combustion engine of the vehicle.

In the embodiment shown in FIG. 1, the discharge passage 117 is located on the opposite side of the pump housing 110, which is opposite from the suction passage 112*a* in the axial direction. Alternatively, the discharge passage 117 and the suction passage 112*a* may be placed on the same axial side of the pump housing 110.

What is claimed is:

1. A fluid pump comprising:

an inner rotor that is shaped into a cylindrical tubular form and has a plurality of external teeth;

an outer rotor that has a plurality of internal teeth for meshing with the plurality of external teeth;

a pump housing that receives the outer rotor and the inner rotor and forms a plurality of pump chambers between the plurality of internal teeth and the plurality of external teeth, wherein each of the plurality of pump chambers draws and compresses fluid by changing a volume of the pump chamber;

a rotatable shaft that is placed to extend over both of:

a high pressure passage, which conducts the fluid discharged from each corresponding one of the plurality of pump chambers; and an inside of the pump housing;

a joint member that couples between the inner rotor and the rotatable shaft to transmit a rotational torque of the rotatable shaft to the inner rotor; and a radial bearing that is shaped into a cylindrical tubular form, wherein the radial bearing rotatably and slidably supports the rotatable shaft through a cylindrical inner peripheral surface of the radial bearing and rotatably and slidably supports an inner peripheral surface of the inner rotor through a cylindrical outer peripheral surface of the radial bearing, and wherein at least one lubrication groove is formed in the cylindrical outer peripheral surface of the radial bearing and accumulates the fluid, which is present in the inside of the pump housing, wherein:

a region of the pump housing, in which at least one of the plurality of pump chambers draws the fluid, is defined as a suction region;

another region of the pump housing, in which at least another one of the plurality of pump chambers compresses the fluid, is defined as a compression region; and the at least one lubrication groove is located only in an angular extent of the suction region in a rotational direction of the inner rotor.

2. The fluid pump according to claim 1, comprising:

a suction passage that is formed in the pump housing and conducts the fluid to be drawn into the at least one of the plurality of pump chambers; and a suction groove that is formed in an inside wall surface of the pump housing and is communicated with the suction passage while the suction groove is shaped to extend along a rotational path of the plurality of external teeth and a rotational path of the plurality of internal teeth, wherein:

the at least one lubrication groove is located in an angular extent of the suction groove in the rotational direction.

3. The fluid pump according to claim 2, wherein the at least one lubrication groove is located in an angular extent of the suction passage in the rotational direction.

4. The fluid pump according to claim 1, wherein:

the radial bearing includes:

a slide portion, which slidably supports the inner rotor; and a seal portion, which tightly contacts the pump housing; and the at least one lubrication groove is located in a portion of the cylindrical outer peripheral surface of the radial bearing, which forms the slide portion and is displaced from the seal portion.

5. The fluid pump according claim 1, further comprising:

a suction passage that is formed in the pump housing and conducts the fluid to be drawn into the at least one of the plurality of pump chambers; and a suction groove that is formed in an inside wall surface of the pump housing and is communicated with the suction passage while the suction groove is shaped to extend along a rotational path of the plurality of external teeth and a rotational path of the plurality of internal teeth, wherein the at least one lubrication groove is located only in an angular extent of the suction passage in the rotational direction.

6. The fluid pump according claim 1, wherein the radial bearing includes:

a slide portion that includes the cylindrical outer peripheral surface of the radial bearing, which slidably supports the inner rotor; and a seal portion that is formed integrally with the slide portion in one piece and is located on an opposite side of the slide portion, which is opposite from the joint member in an axial direction of the rotatable shaft, while the seal portion is press fitted into a through-hole of the pump housing in the axial direction to seal between the seal portion and the pump housing, and an outer diameter of the seal portion is larger than an outer diameter of the slide portion.

7. The fluid pump according claim 1, wherein the joint member includes:

a main body that has a fitting hole, into which the rotatable shaft is fitted to rotate integrally with the rotatable shaft; and a plurality of legs that are formed integrally with the main body in one piece from a resin material and extend from the main body in an axial direction of the rotatable shaft, while the plurality of legs is respectively inserted into a plurality of insertion holes of the inner rotor in the axial direction to transmit the rotational torque of the rotatable shaft to the inner rotor.

* * * * *